US007648443B2

(12) United States Patent
Schenk

(10) Patent No.: US 7,648,443 B2
(45) Date of Patent: Jan. 19, 2010

(54) ZERO-LEARNING-CURVE EXERCISE CONSOLE

(76) Inventor: Peter Schenk, 2730 Daybreaker Dr., Park City, UT (US) 84098

( * ) Notice: Subject to any disclaimer, the term of this patent is extended or adjusted under 35 U.S.C. 154(b) by 645 days.

(21) Appl. No.: 11/389,878

(22) Filed: Mar. 27, 2006

(65) Prior Publication Data

US 2007/0225120 A1 Sep. 27, 2007

(51) Int. Cl.
*A63B 71/00* (2006.01)

(52) U.S. Cl. ..... 482/3; 482/1; 482/8

(58) Field of Classification Search ..... 482/1–9, 482/51, 54, 900–902, 57; 600/500; 434/247
See application file for complete search history.

(56) References Cited

U.S. PATENT DOCUMENTS 5,383,826 A 1/1995 Michael
5,512,025 A 4/1996 Dalebout et al.
5,527,239 A * 6/1996 Abbondanza ..... 482/8
5,629,668 A 5/1997 Downs
5,704,581 A 1/1998 Chen
5,769,755 A 6/1998 Henry
5,795,301 A * 8/1998 Yasukawa et al. ..... 600/500
5,947,869 A * 9/1999 Shea ..... 482/8
6,312,363 B1 * 11/2001 Watterson et al. ..... 482/54
6,447,424 B1 * 9/2002 Ashby et al. ..... 482/8
6,458,060 B1 * 10/2002 Watterson et al. ..... 482/54
6,626,803 B1 9/2003 Oglesby
6,659,916 B1 12/2003 Shea
6,776,740 B1 8/2004 Anderson et al.
7,056,265 B1 * 6/2006 Shea ..... 482/8
7,344,481 B2 * 3/2008 Watterson et al. ..... 482/54
7,507,183 B2 * 3/2009 Anderson et al. ..... 482/1
2006/0183603 A1 * 8/2006 Astilean ..... 482/8

OTHER PUBLICATIONS

Life Fitness, *Attachable LCD with E-Z TV Console,* Product Highlights and Specifications, http://us.commercial.lifefitness.com/content.cfm/attachablelcdwitheztvcons. . , (Jul. 25, 2006), pp. 1-3.
Life Fitness, *Attachable LCD Entertainment System,* Product Highlights and Specifications, http://au.commercial.lifefitness.com/content.cfm/attachablelcdentertainme. . , (Jul. 25, 2006), pp. 1-3.
Life Fitness, *LCD Entertainment System,* Product Highlights and Specifications, http://us.commercial.lifefitness.com/content.cfm/lcdentertainmentsystem?pff=1, (Jul. 18, 2006), pp. 1-3.

(Continued)

*Primary Examiner*—Glenn Richman
(74) *Attorney, Agent, or Firm*—Pate Pierce & Baird

(57) ABSTRACT

An exercise console is disclosed as including a housing and a display incorporated into the housing. The display is adapted to align substantially parallel to the top surface of the housing. A tilt mechanism connects the display to the housing and is operable by a user to tilt the display to a nonparallel angle with respect to the housing. In another aspect in accordance with the invention, the exercise console includes a substantially fixed array of buttons incorporated into the housing. The buttons provide to a user various input options which are selectable in a pre-determined sequence by operation of the buttons to program the exercise console. Various indicators are associated with the buttons and inform the user which input options are next available for selection after the user has selected one or more input options.

20 Claims, 10 Drawing Sheets

OTHER PUBLICATIONS

Life Fitness, *E'Integrated LCD System with Touch Screen Technology,* Product Highlights and Specifications, http://us.commercial.lifefitness.com/content.cfm/e3integreatedlcdsystem?pff=1, (Jul. 18, 2006), pp. 1-3.

* cited by examiner

ZERO-LEARNING-CURVE EXERCISE CONSOLE

BACKGROUND

1. The Field of the Invention

This invention relates to exercise equipment and more particularly to display and control consoles for exercise equipment such as treadmills and stationary bicycles.

2. Background

As in other industries, designers in the exercise equipment industry face challenges if they try to incorporate modern technological advances into traditional exercise equipment, which may include, for example, stationary bicycles, treadmills, elliptical machines, rowing machines, stair climbers, nautilus machines, and the like. Compared to relatively simple devices of the past, modern exercise devices now could incorporate many sophisticated computers and electronics but must often deal with the position and posture dictated by the user and the activity. Technology could enable a user to perform tasks such as tailoring an exercise program to a user's fitness level, selecting a preferred training method, adjusting a device to a user's weight, controlling speed, monitoring body functions, adjusting resistance, and the like. Moreover, modern exercise devices could allow a user to track and monitor a user's progress on the device while exercising. However, access, visibility, and interaction need to be compatible with a user and not a distraction or a burden.

Typically, a control console provides the primary means of interaction between a user and a functional device. An exercise console may include input devices, such as keypads, keyboards, buttons, or the like, to receive user input and thereby allow a user to program and control an exercise device. An exercise console may also include a display device to display pertinent information, such as workout progress, program settings, speed, resistance levels, and the like. For example, light emitting diode ("LED") displays have been used in various devices to display information. Such LED displays often include arrays or other arrangements of LEDs and provide a bright, low-power solution for displaying information. However, LED displays are limited by low resolution and very few available colors.

More recently, newer displays, such as liquid crystal displays ("LCDs"), offer higher resolutions and greater arrays of available colors. Moreover, LCDs could be used to display entertainment, such as television, movies, music videos, and the like, in addition to workout information. Nevertheless, LCDs also have their drawbacks. For example, LCDs may be significantly more expensive than LED displays, less bright, less contrasting, more subject to glare, and subject to a much narrower viewing angle.

Problems with the viewing angle may be especially pronounced in exercise devices used at gyms, where patrons of different heights may use the same device. For example if a separate pivoting LCD were attached to the top of an exercise console, this configuration would be expensive, cumbersome, require multiple components, and obstruct a user's field of view. This could also affect the affordability and market competitiveness of an exercise device in an industry where there are significant pressures to keep costs low.

Another problem with modern processor-based equipment and controllers, including exercise consoles, is the learning curve often needed to operate and use such devices. It is difficult for users to learn how to use the unique programming scheme, let alone recall it when needed. That is, as the sophistication of control consoles increases, the complexity of operation often likewise increases. Where buttons are provided on the exercise console, it may be time-consuming for a user to determine which buttons to push and the order in which to push them. Furthermore, a user may not have the time or patience to read and refer repeatedly to a user manual. Likewise, using exercise time to read through instructions printed in a small font at an awkward distance on the device or an associated exercise console may be considered a waste. This can be especially frustrating for the technologically challenged or phobic or the user who switches between different exercise devices at a club. This may also discourage some from exercising at all due to the inconvenience involved in getting a device to serve them.

In view of the foregoing, what is needed is an exercise console that takes advantage of newer LCD technology, while avoiding many of the shortcomings discussed herein. Specifically, an exercise console is needed that can incorporate LCD technology while accommodating users of different heights. Such a device would ideally be inexpensive, simple, and adaptable to accommodate a user's field of view.

Further needed are apparatus and methods for reducing the learning curve needed to operate and use many exercise consoles. Where buttons are used on an exercise console, apparatus and methods are needed for quickly indicating to a user which buttons to push and the order to push them. Such apparatus and methods would ideally minimize the amount of time and reading needed to program and operate a device and accommodate the technologically inexperienced, challenged, or phobic.

BRIEF SUMMARY AND OBJECTS OF THE INVENTION

Consistent with the foregoing, and in accordance with the invention as embodied and broadly described herein, an exercise console is disclosed in one embodiment in accordance with the invention as including a housing and a display incorporated into the housing. The display is adapted to align substantially parallel to the top surface of the housing. A tilt mechanism connects the display to the housing and is operable by a user to tilt the display to a nonparallel angle with respect to the housing.

The tilt mechanism may incorporate a number of different structures to provide the tilting function including, for example, a hinge, a pin, a slide, a land, or the like. Similarly, in selected embodiments, the tilt mechanism may tilt the display about a single axis of rotation. In other embodiments, the tilt mechanism may tilt the display about multiple axes of rotation. In certain embodiments, the exercise console may also include an adjustment mechanism to adjust the angle of the display with respect to the housing. This adjustment mechanism may be continuously adjustable between various positions, or alternatively, be adjustable at discrete positions. The exercise console may also include a handle integrated into the display to facilitate tilting by a user.

In another aspect of an embodiment in accordance with the invention, a method for displaying exercise and entertainment content to a user includes providing a housing and incorporating a display into the housing. The display aligns substantially parallel to the top surface of the housing. The method further includes connecting the display to the housing by way of a tilt mechanism. The tilt mechanism is operable by a user to tilt the display to a nonparallel angle with respect to the housing. The nonparallel angle may be completely arbitrary, continuously variable, or discrete and at the option of a user.

In another aspect of an embodiment in accordance with the invention, a method for guiding a user through programming steps of an exercise console includes providing a substantially fixed array of buttons for interaction with a user. The buttons provide various input options to the user, selectable in a pre-determined sequence by operation of the buttons to program an exercise console. The method further includes selecting, by the user, one or more input options from the several input options. The method then determines which input options are available for selection by the user after selection of the one or more input options. Once this determination is made, the method then automatically indicates to the user which buttons and associated input options are next available for selection.

In another aspect of an embodiment in accordance with the invention, an exercise console includes a housing and a substantially fixed array of buttons incorporated into the housing. The buttons provide a user various input options which are selectable in a pre-determined sequence by operation of the buttons. The selected sequence of input options are used to program the exercise console. Various indicators are associated with the buttons and inform the user which input options are next available for selection after the user has selected one or more input options.

The indicators may include, for example, lights, sounds, or changing colors to indicate which input options are available for selection. Where lights are used, the lights may be LEDs and may be flashing to get the user's attention. In certain embodiments, the lights may be located substantially behind the buttons (i.e., backlighting the buttons), projecting through the buttons, beside them, or illuminating the front. Buttons may be opaque, translucent, transparent, reflective, or the like. In certain embodiments, the exercise console may be configured to wait a specified period to allow a user to select one of the input options. If the user does not act within the specified period, the exercise console may be configured to modify the input options available for next selection.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of apparatus and methods in accordance with the present invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
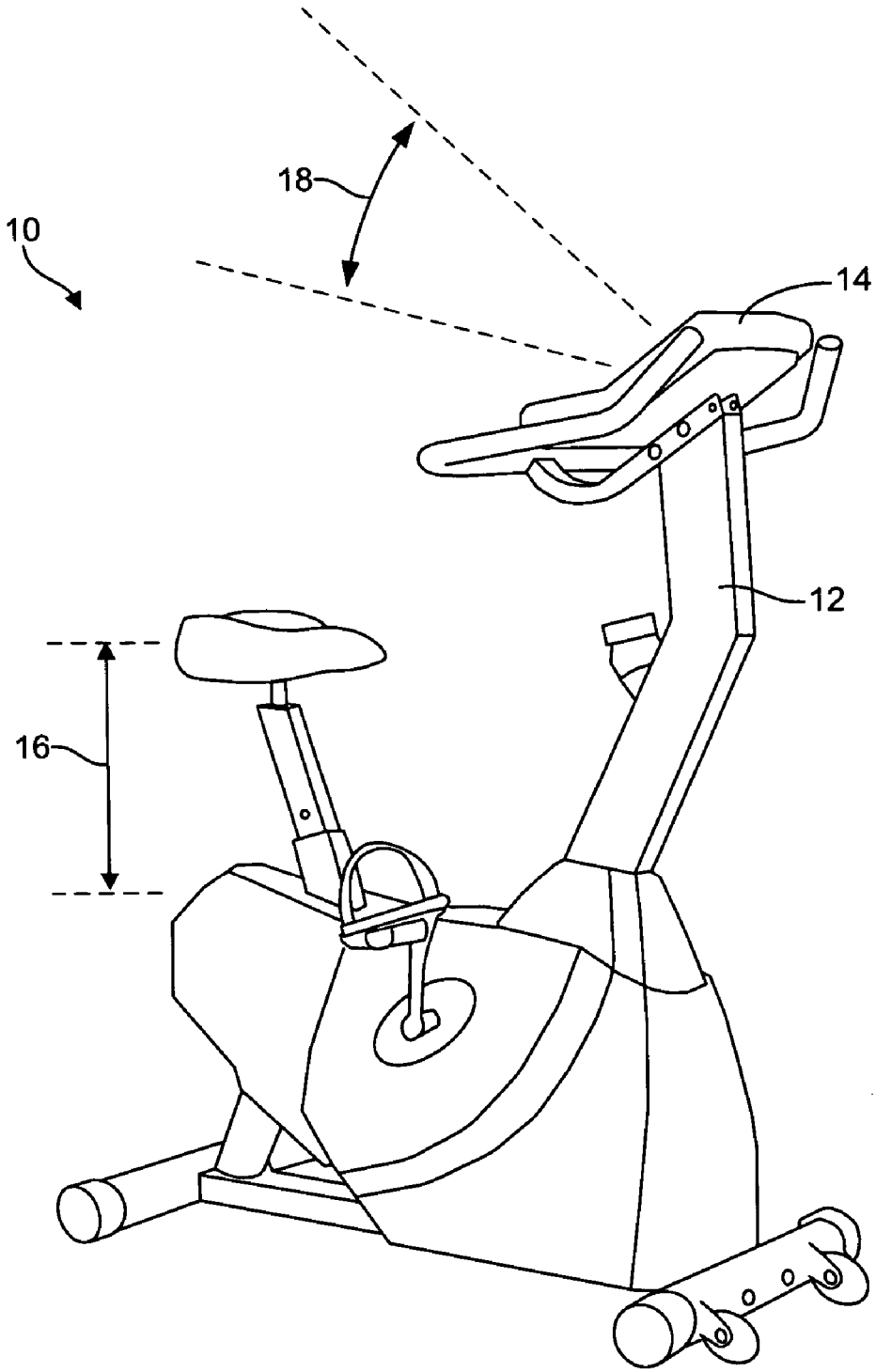
FIG. 1 is a perspective view of one embodiment of an exercise device in accordance with the invention.

Referring to FIG. 1, an exercise device 10 in accordance with the invention may include a frame 12, or other structure 12, and an exercise console 14 substantially rigidly attached to the frame 12. As previously mentioned, an exercise console 14 typically enables a user to perform tasks such as to program, control, and monitor progress on an exercise device 10. Although illustrated as a stationary bicycle in this example, an exercise device 10 in accordance with the invention may include a wide variety of different devices, including but not limited to stationary bicycles, treadmills, elliptical machines, rowing machines, climbing machines, stair-climbing machines, nautilus machines, stretching machines, and the like. Thus, an exercise console 14, as described herein, may be used with a wide variety of different exercise devices 10 and not the just the illustrated device 10.

To keep costs down and improve the quality of the end product, exercise devices 10, like many other devices, may be mass produced. Thus, each device 10 may be substantially identical, although some characteristics, such as seat height 16 in this example, may be adjusted to accommodate users of different heights and sizes. Nevertheless, each user may still interact with the device 10 differently. For example, users of different heights may view the exercise console 14 of a device 10 from a range 18 of different angles. While this may not cause problems with LED displays, this may limit the ability to view newer types of displays, such as LCDs, which may be more subject to glare and have a narrower viewing angle.

Figure 2:
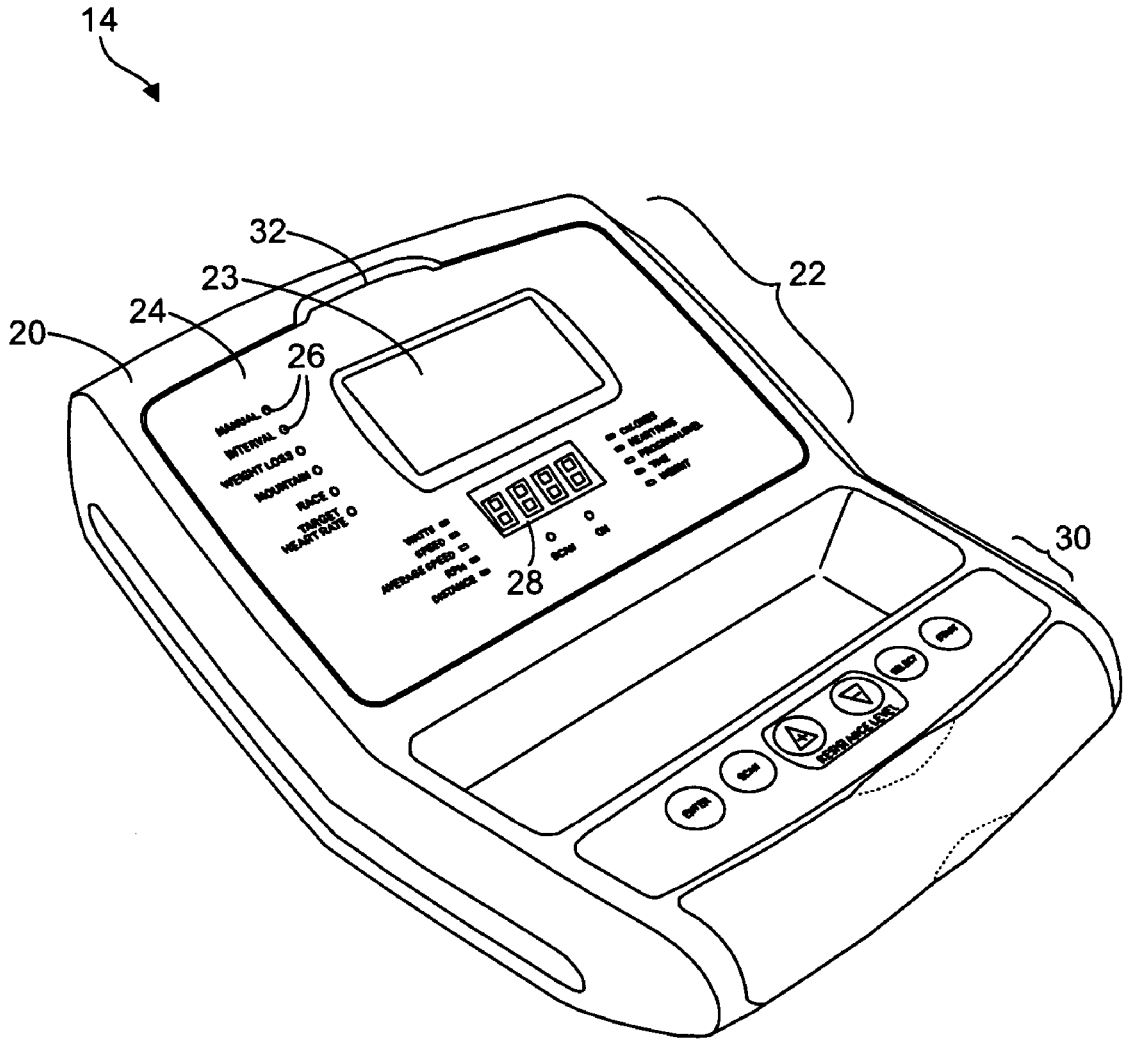
FIG. 2 is a perspective view of one embodiment of an exercise console incorporating an integrated tilting display in accordance with the invention.
Figure 3:
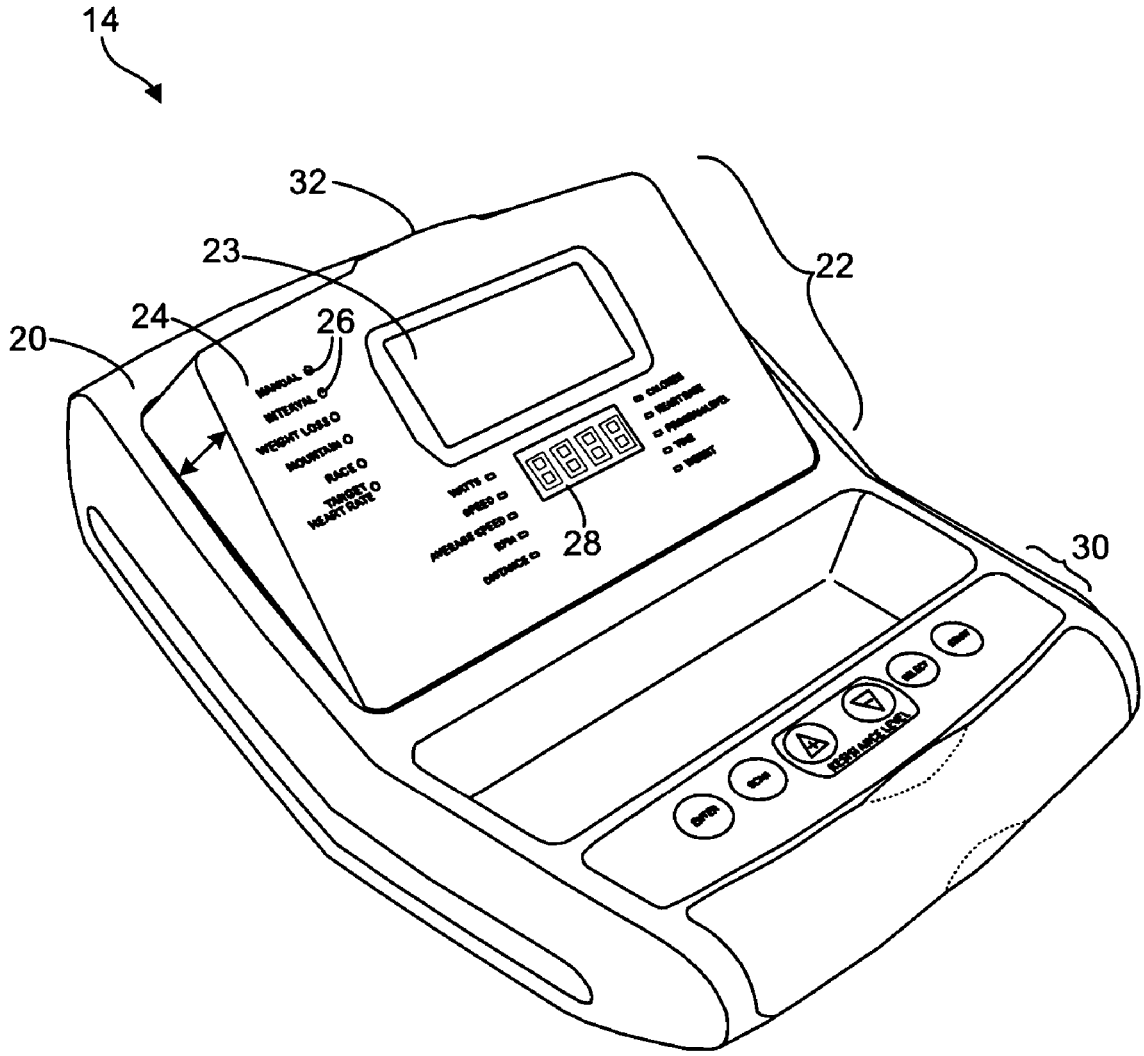
FIG. 3 is a perspective view of the exercise console illustrated in FIG. 2 with the display in a tilted position with respect to the top surface of the console.

Referring to FIGS. 2 and 3, in certain embodiments, an exercise console 14 in accordance with the invention may include a housing 20 and a display 22 integrated into the housing 20. The display 22 may be used to display a wide variety of information, including but not limited to a user's workout program, the current speed of a device 10, the distance a user has theoretically traveled on the device 10, the time a user has been working out, body functions (e.g., heart rate) of a user, resistance levels of a device 10, or energy expended, to name just a few. For the purposes of this description, the term "display" is used to mean not only a display screen 23, such as an LCD screen, but also any area 24, frame 24, or the like surrounding a display screen 23. This area 24 may, in certain embodiments, include other display elements including but not limited to LEDs 26, written materials, seven segment LED displays 28, or the like.

The exercise console 14 may also include an array of buttons 30 incorporated into the housing 20. For the purposes of this description, the term "button" means any type of physical button, including but not limited to keys on a keyboard or keypad, switches, or buttons incorporated into a housing of equipment. The buttons 30 may provide various input options to a user which may be selectable in a predetermined sequence to program the exercise console 14.

In accordance with the invention, a display 22 may independently tilt with respect to the housing 20 to accommodate users of different heights or positions. For example, in one contemplated embodiment, the display 22 may sit within a recess or void formed in the housing 20. In a stored position, the display 22 may reside substantially parallel to a top surface of the housing 20, as illustrated in FIG. 2. In an extended position, the display 22 may tilt to a non-parallel position with respect to the top surface of the housing 20, as illustrated in FIG. 3. In certain embodiments, a handle 32 such as a tab or flange may be integrated into the display 22 to facilitate tilting by a user.

By adjusting the angle of the display 22 appropriately, the display 22 may be adjusted to accommodate most, if not all, users. Moreover, as will be explained in more detail hereafter, an adjustment mechanism may be provided to allow the display 22 to be adjusted continuously to any intermediate position between a stored position and an extended position. Alternatively, the display 22 may be adjusted to discrete positions between a stored position and an extended position.

The tilting display illustrated in FIGS. 2 and 3 provides various significant advantages over other systems. For example, because the display 22 is integrated into the housing 20, the console 14 may be manufactured as a single component or assembly. This may reduce costs compared to systems where a separate LCD or other display is mounted to the top of the exercise console 14 or the exercise device 10. Furthermore, the integrated design of the display 22 preserves a user's field of vision around the exercise device 10 compared to systems where a separate LCD or other display is mounted to the top of the exercise console 14, obstructing vision. The integrated display 22 also provides a compact and attractive design compared to other alternatives. Furthermore, the tilting display 22 also allows the housing 20 to be rigidly mounted to the frame 12 or other structure 12 of the exercise device 10. This allows the buttons 30 to remain substantially stationary even while the display 22 tilts to different angles.

The tilting nature of the display 22 may be used to significantly improve the visibility of content displayed on newer display screens 23, such as LCD screens 23, that are integrated into the display 22. This greatly improves the utility of the display 22 and may be used to increase the amounts and types of content displayed to a user. For example, in addition to workout information, an LCD screen 23 may be used to display entertainment, such as digital video, cable or over-the-air television, music videos, news, or many other types of video content. In certain embodiments, both entertainment and workout information may be displayed simultaneously or a user may toggle between different kinds of content.

Figure 4A:
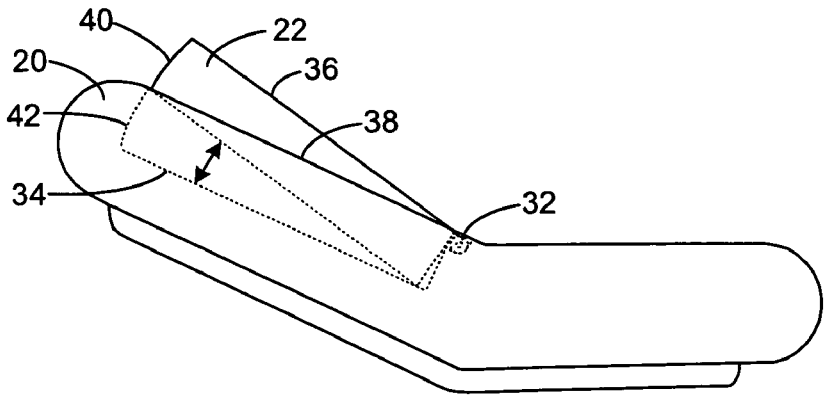
FIGS. 4A through 4D are side elevation views of different embodiments of tilting displays in accordance with the invention.

Referring to FIG. 4A, in one embodiment, a display 22 in accordance with the invention may tilt with respect to the housing 20 using a hinge 32. The hinge 32 may be hidden from view inside the housing 20 and may be monolithically formed as part of the display 22, the housing 20, or a combination thereof. In its stored position, the display 22 may reside in a recess 34 formed in the housing 20 and a top surface 36 of the display 22 may sit substantially parallel with the top surface 38 of the housing 20. In certain embodiments, the top surface 36 may also fit substantially flush with the top surface 38 of the housing 20 when in the stored position.

Because the display 22 may sweep over a substantially circular path as it pivots about the hinge 32, in certain embodiments, the display 22 may be provided with a rounded contour 40. Similarly, the recess 34 may also be provided with a rounded contour 42 substantially conforming to the display 22. These rounded contours 40, 42 may allow a relatively close fit between the display 22 and the recess 34 while preventing interference between the two.

Figure 4B:
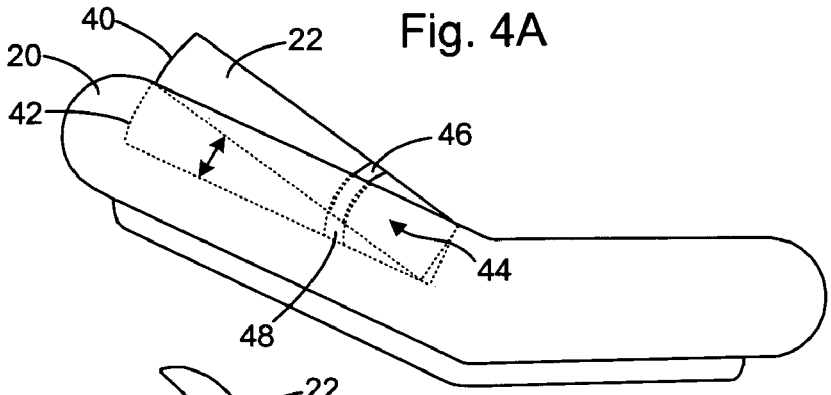

Referring to FIG. 4B, in another embodiment, a tilt mechanism may be provided in the form of a slide 44. In one embodiment, the slide 44 may include a land 46, incorporated into the display 22, that slides within a slot 48, incorporated into the housing 20. In another embodiment, the land 46 may be incorporated into the housing 20 and the slot 48 may be incorporated into the display 22. The slide 44 may allow the display 22 to pivot about a selected point, whether located on the housing 20 or not, simply by adjusting the curvature, or radius, of the land 46 and slot 48. Although a single slide 44 is illustrated in this embodiment, in other embodiments, additional slides 44 may be integrated into the display 22 and housing 20 to provide additional stability. For example, a second slide 44 may be added closer to the upper ends 40, 42 of the display 22 and housing 20.

Figure 4C:
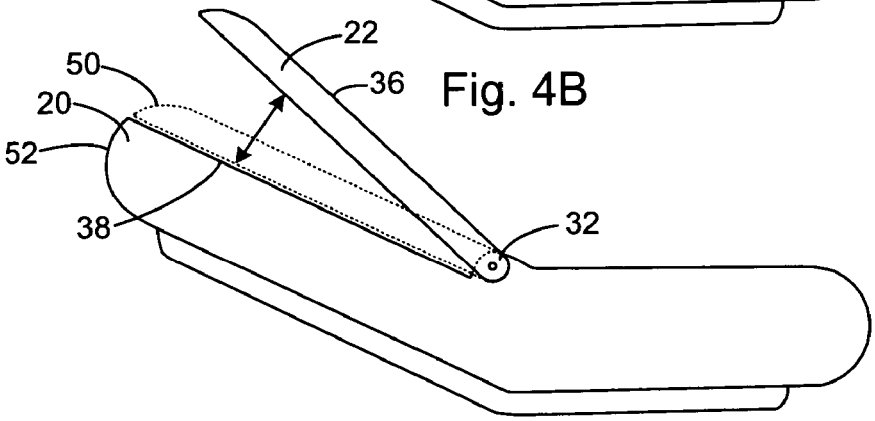

Referring to FIG. 4C, in yet another embodiment, the display 22 may be enlarged to form a panel covering a significant portion of the housing 20. Such an enlarged panel may be used to accommodate a larger display screen 23, additional LEDs, or the like. As can be appreciated, a larger display screen 23 may be used to display more content, including workout information and entertainment. In certain embodiments, the display 22 may attach to the housing 20 and pivot with respect thereto using a hinge 32. To maintain the angle and position of the display 22, the hinge 32 may employ a friction mechanism, or clutch, similar to those used on many laptop computers.

When in a stored position, the display 22 may rest substantially against the housing 20 and the top surface 36 of the display 22 may align substantially parallel to the top surface 38 of the housing 20. Furthermore, in certain embodiments, the display 22 may be formed such that the display 22 and housing 20 provide a smooth contour. That is, a surface 50 of the display 22 and a surface 52 of the housing 20 may provide a smooth continuous contour.

Figure 4D:
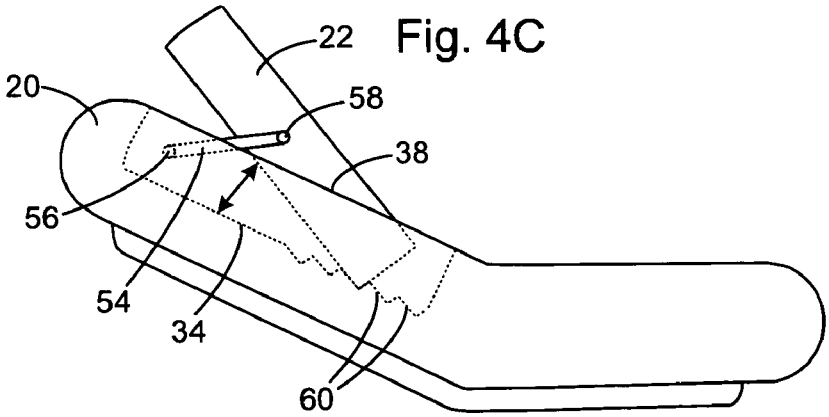

Referring to FIG. 4D, in another embodiment, the display 22 may be sustained by a pivoting support 54. The pivoting support 54 may include a first end 56 pivotally attached to the housing 20 and a second end 58 pivotally attached to the display 22. When the display 22 is in the stored position, the pivoting support 54 may align substantially parallel to the top surface 38 of the housing 20. However, when the display 22 is titled relative to the top surface 38 of the housing 20, the pivoting support 54 may pivot upward to support the display 22.

In certain embodiments, the display 22 may rest in various notches 60, grooves 60, or the like, formed in the bottom of the recess 34, depending on the display angle desired by a user. Unlike the tilt mechanisms described in FIGS. 4A through 4C, the tilt mechanism illustrated in FIG. 4D allows the display 22 to pivot about multiple axes of rotation. This "dual axis" embodiment allows the display 22 to maintain a relatively constant distance from the user even as the display is tilted to enhance the viewing angle of the user.

Figure 5A:
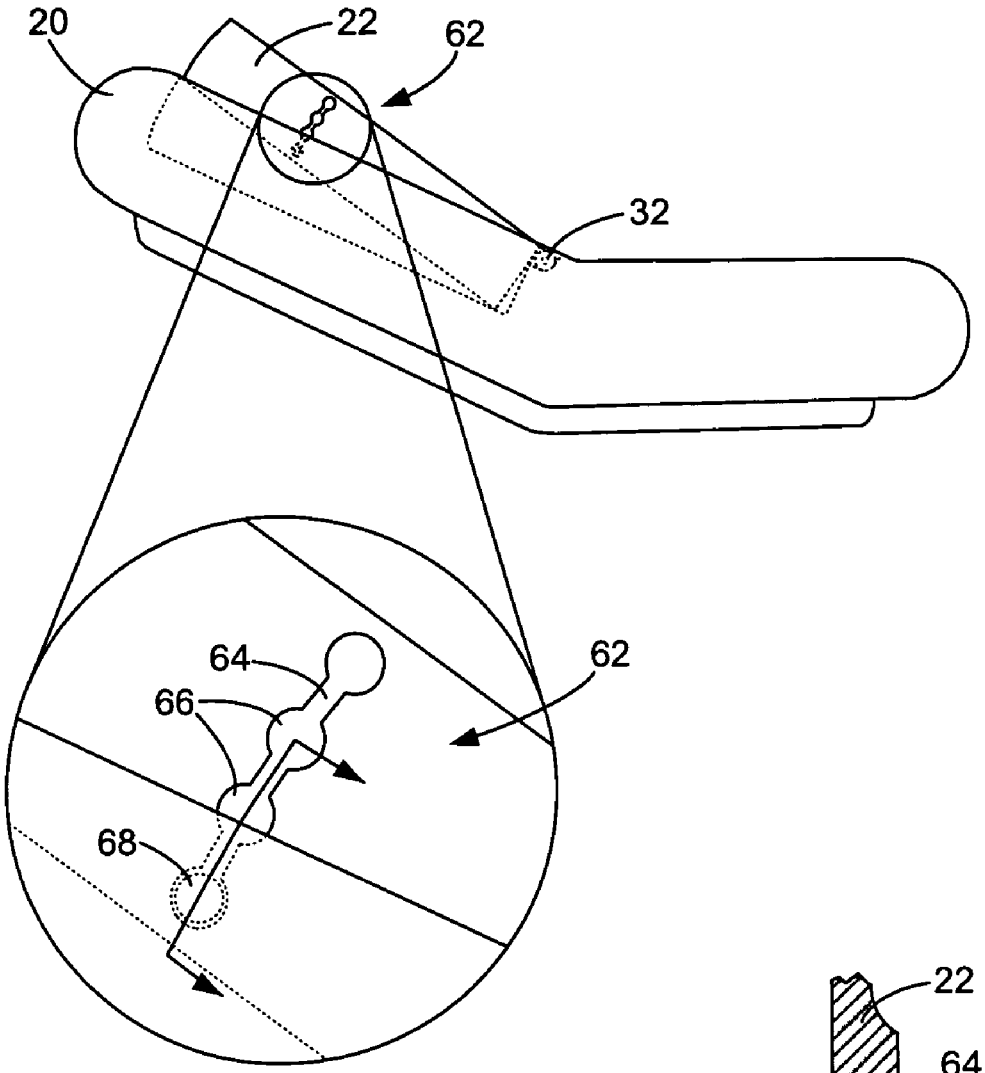
FIG. 5A is a side elevation view of one embodiment of an angle adjustment mechanism for use with an integrated tilting display in accordance with the invention.

Referring to FIG. 5A, to allow the display 22 to maintain a desired viewing angle, an adjustment mechanism 62 may be provided. As previously mentioned, an adjustment mechanism 62 may allow continuous adjustment of the display 22 relative to the housing 20 or, alternatively, adjustment to discrete positions. For example, one embodiment of an adjustment mechanism 62 may include a groove 64, or slot 64, formed in the display 22. This groove 64 may widen and/or deepen at various locations, as shown by the circular recesses 66. A corresponding circular projection 68 may be formed in the housing 20 to slide along the groove 64 and come to rest in each of the circular recesses 66. Thus, in this embodiment of an adjustment mechanism 62, the display 22 may be adjusted to various discrete positions corresponding to the circular projection 68 coming to rest in each of the circular recesses 66.

Figure 5B:
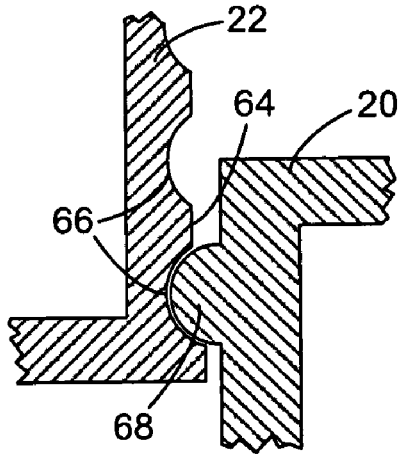
FIG. 5B is a cutaway cross-sectional view of the angle adjustment mechanism illustrated in FIG. 5A.

FIG. 5B illustrates a cutaway cross-sectional view of the groove 64, the circular recesses 66, and the circular projection 68 described in association with FIG. 5A. As shown, the circular projection 68 slides along the groove 64 and comes to rest in the circular recesses 66. As a user exerts force on the display 22, the circular projection 68 will pop out of a recess 66, slide along the groove 64, and pop into an adjacent recess 66. Because the display 22 and housing 20 are generally constructed of a flexible material, such as plastic, this flexibility allows the projection 68 to pop into and out of the recesses 66. In general, such a detent may be formed in a variety of ways, and may be configured to resist but accommodate movement upon the application of sufficient force to deflect either the projection 68, recess 66, or both.

FIGS. 5A and 5B illustrate one contemplated embodiment of an adjustment mechanism 62 in accordance with the invention. One of ordinary skill in the art will recognize, however, that other adjustment mechanisms 62 may be suitable for use with the present invention. For example, an adjustment mechanism 62 employing a simple thumbscrew (not shown) may be used to adjust the angle of the display 22. The thumbscrew may be loosened to adjust the display 22 and tightened to lock the display 22 in place. This provides a continuous means of adjustment.

In another embodiment, a hinge 32 comprising a friction mechanism or clutch may be used in place of the adjustment mechanism 62 illustrated in FIGS. 5A and 5B. This also provides a continuous means of adjustment. Other types or variations of adjustment mechanisms 62 may also be used and are within the scope of the invention.

Figure 6:
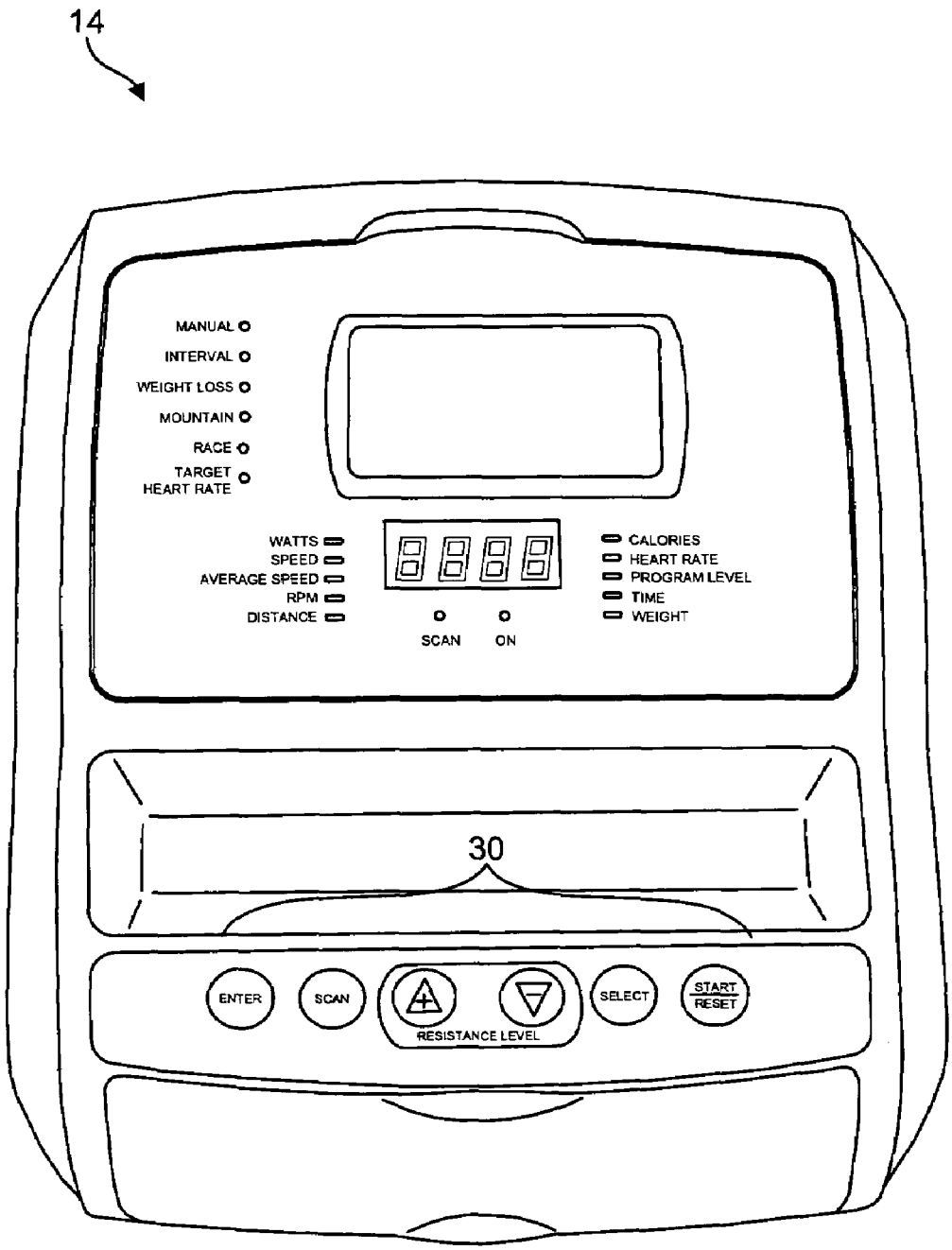
FIG. 6 is a top plan view of an exercise console with an integrated tilting display in accordance with the invention.

Referring to FIG. 6, as previously mentioned, an exercise console 14 may provide a substantially fixed array of buttons 30 for operation by a user. These buttons 30 may provide a user various input options which are selectable in a predetermined sequence by operation of the buttons 30. For example, in the illustrated embodiment, the buttons 30 may provide input options such as "enter," "scan," "select," "start," "reset," and arrows for adjusting resistance levels, a workout program selected, workout level, workout time, a speed, user weight, or the like. In order to program the exercise console 14, the user selects the correct buttons 30 and selects them in the correct order.

Nevertheless, even where very few buttons 30 are involved, this process can be confusing and time-consuming, especially for the technologically unsophisticated or phobic user. One cause of this problem is that different brands, models, and types of exercise devices 10 may use different buttons 30, use different labels on the buttons 30, require different inputs, require a different order of inputs, or the like. Thus, improved apparatus and methods are needed to guide a user through the steps needed to program an exercise device 10, thereby reducing the learning curve needed to operate a device 10.

Figure 7A:
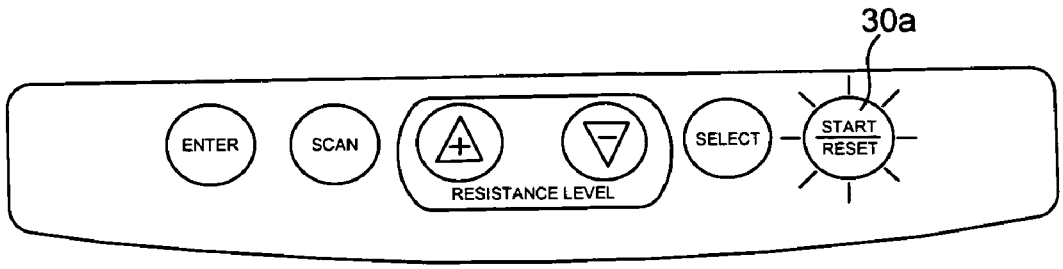
FIGS. 7A through 7D are schematic block diagrams illustrating one embodiment of a method for using backlit buttons to guide a user through programming steps of an exercise console.

FIGS. 7A through 8D illustrate one embodiment of a method for guiding a user through the programming steps of an exercise console 14. The illustrated embodiment simply provides one example of a method in accordance with the invention and is not intended to limit the scope of the invention, as recited in the claims. As illustrated in FIG. 7A, in one embodiment, before a user begins the programming process, a "start" or "reset" button 30*a* may flash to indicate to the user that this button should be selected to start the programming process. The user may then select this button 30*a* to begin the exercise console 14 programming process. Once the user selects the "start" button 30*a*, the exercise console 14 then determines the input options that are next available for selection.

Figure 7B:
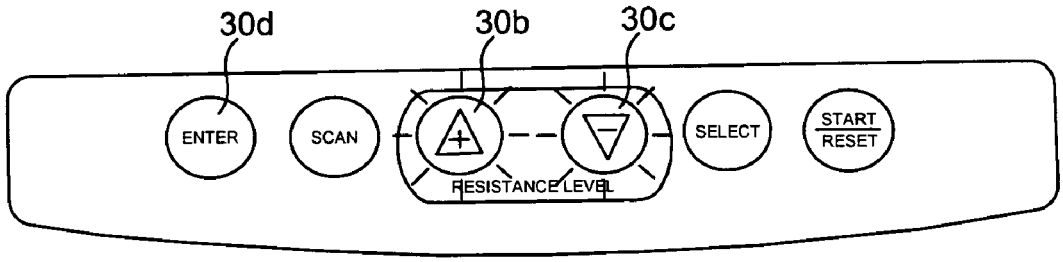

For example, referring to FIG. 7B, arrow buttons 30*b*, 30*c* may begin to flash to indicate that the user should select a workout program. Using the arrow buttons 30*b*, 30*c*, the user may scroll or otherwise navigate through various workout programs. For example, by using the arrows 30*b*, 30*c*, the user may change between a "manual," "interval," "weight loss," "mountain," "race," and "target heart rate" program. Once the user has navigated to a desired program, the user may immediately select the enter button 30*d* to select the desired program.

Figure 7C:
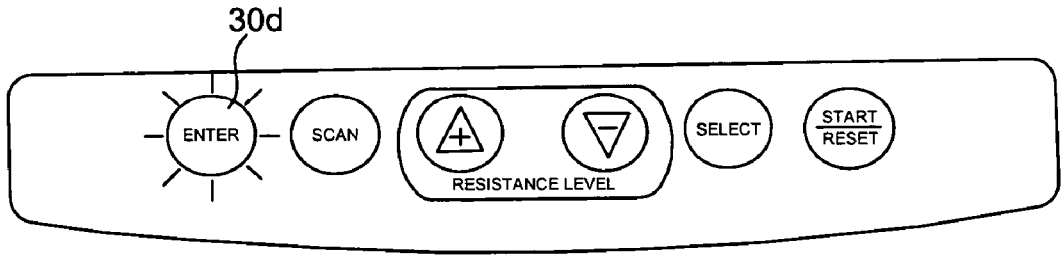

Alternatively, referring to FIG. 7C, if the user does not select the enter button 30*d*, the exercise console 10 may wait a specified period (e.g., three seconds) and the "enter" button 30*d* may begin to flash to indicate to the user that this is the appropriate next selection. The user may then select the "enter" button 30*d* in accordance with this indication.

Figure 7D:
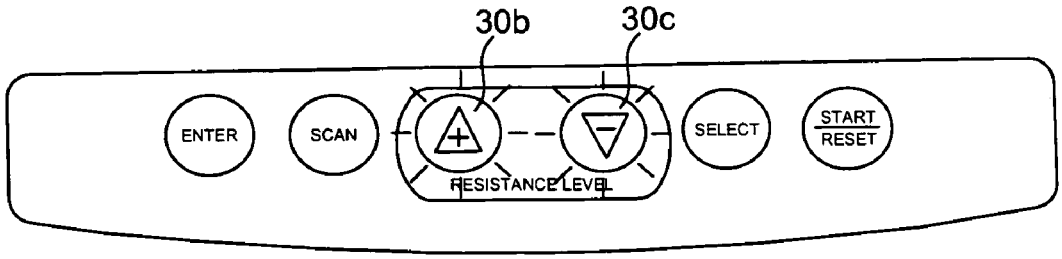

Referring to FIG. 7D, once the user has selected the enter button 30*d*, the arrow buttons 30*b*, 30*c* may again begin to flash to indicate to the user that he or she should select a workout or resistance level corresponding to the selected workout program. For example, by selecting the arrows the user may toggle between level "L1" and "L16" until the user reaches a desired level. Like the previous example, once the user has toggled to a desired workout or resistance level, the user may select the "enter" button 30*d* to enter the level.

Figure 8A:
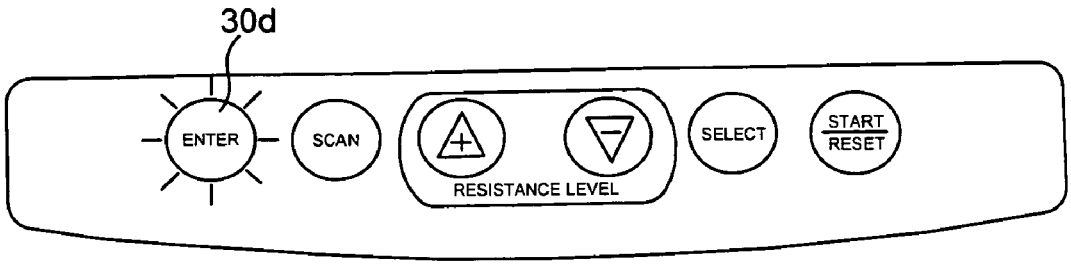
FIGS. 8A through 8D are schematic block diagrams illustrating additional details of a method for using backlit buttons to guide a user through programming steps of an exercise console.

Alternatively, referring to FIG. 8A, if the user does not select the "enter" button 30*d*, the exercise console 14 may again wait a specified period (e.g., three seconds) and the "enter" button 30*d* may begin to flash to indicate to the user that this is the appropriate next selection. The user may then select the "enter" button 30*d* in accordance with this indication to enter the selected level.

Figure 8B:
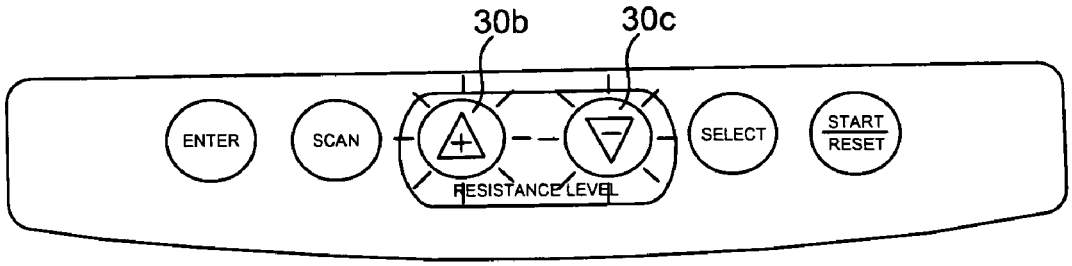

Referring to FIG. 8B, once the "enter" button 30*d* is selected, the arrow buttons 30*b*, 30*c* may again begin to flash to urge the user to select a workout time for the workout program. For example, arrow buttons 30*b*, 30*c* may increment or decrement some control parameter, like the workout time, in intervals, such as one minute intervals. Once the desired time is selected, the user may press the "enter" button 30*d* to enter the selected time.

Figure 8C:
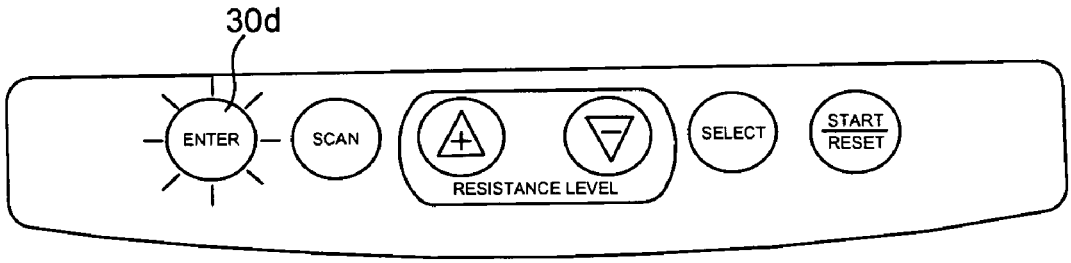

Referring to FIG. 8C, like the previous example, if the user does not select the enter button 30*d* within the specified period (e.g., three seconds), the "enter" button 30*d* may flash to indicate that this is the appropriate next selection. The user may then select the "enter" button 30*d* to enter the selected workout time.

Figure 8D:
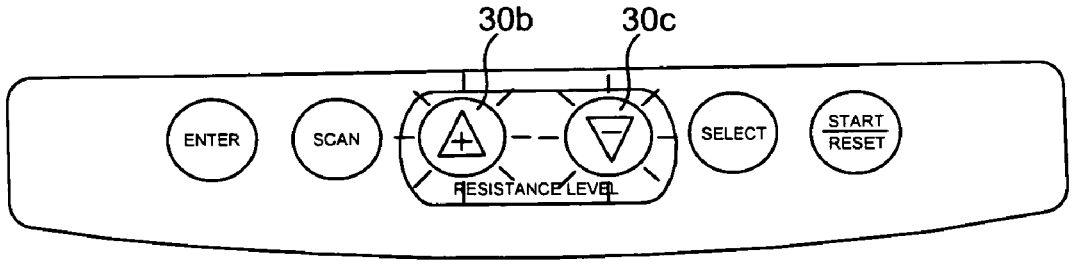

Referring to FIG. 8D, once the enter button 30*d* is selected, the arrow buttons 30*b*, 30*c* may again begin to flash to urge the user to enter the user's weight. Once entered, the user may press the "enter" button 30*d*, or alternatively, if the user does not select the enter button 30*d* within the specified period (e.g., three seconds), the "enter" button 30*d* may flash to indicate that this is the appropriate next selection. The user may then select the "enter" button 30*d* to enter the user's weight in accordance with this indication.

The method described with respect to FIGS. 7A through 8D uses flashing backlit buttons 30 as "indicators" to guide the user through the programming steps of the exercise console 14. These backlit buttons 30 may be provided by LEDs or other lights located behind the buttons 30. Accordingly, the buttons 30 may be made from a transparent or translucent material to allow the light to pass through the buttons 30. Even so, other indicators or variations thereof may be used to lead a user through the programming steps.

For example, instead of lighting up, the buttons 30 may change color or sounds may play to indicate a button 30 is next available for selection. Similarly, instead of backlighting the buttons 30, LED's or other lights located proximate the buttons 30 may light up to indicate the buttons 30 are available for next selection. Thus, a method for guiding a user through the programming steps of an exercise console 14 may use other automated indicators, events, or both to help guide the user. Any and all "indicators" that can be used to implement such a method are within the scope of the present invention.

Figure 9:
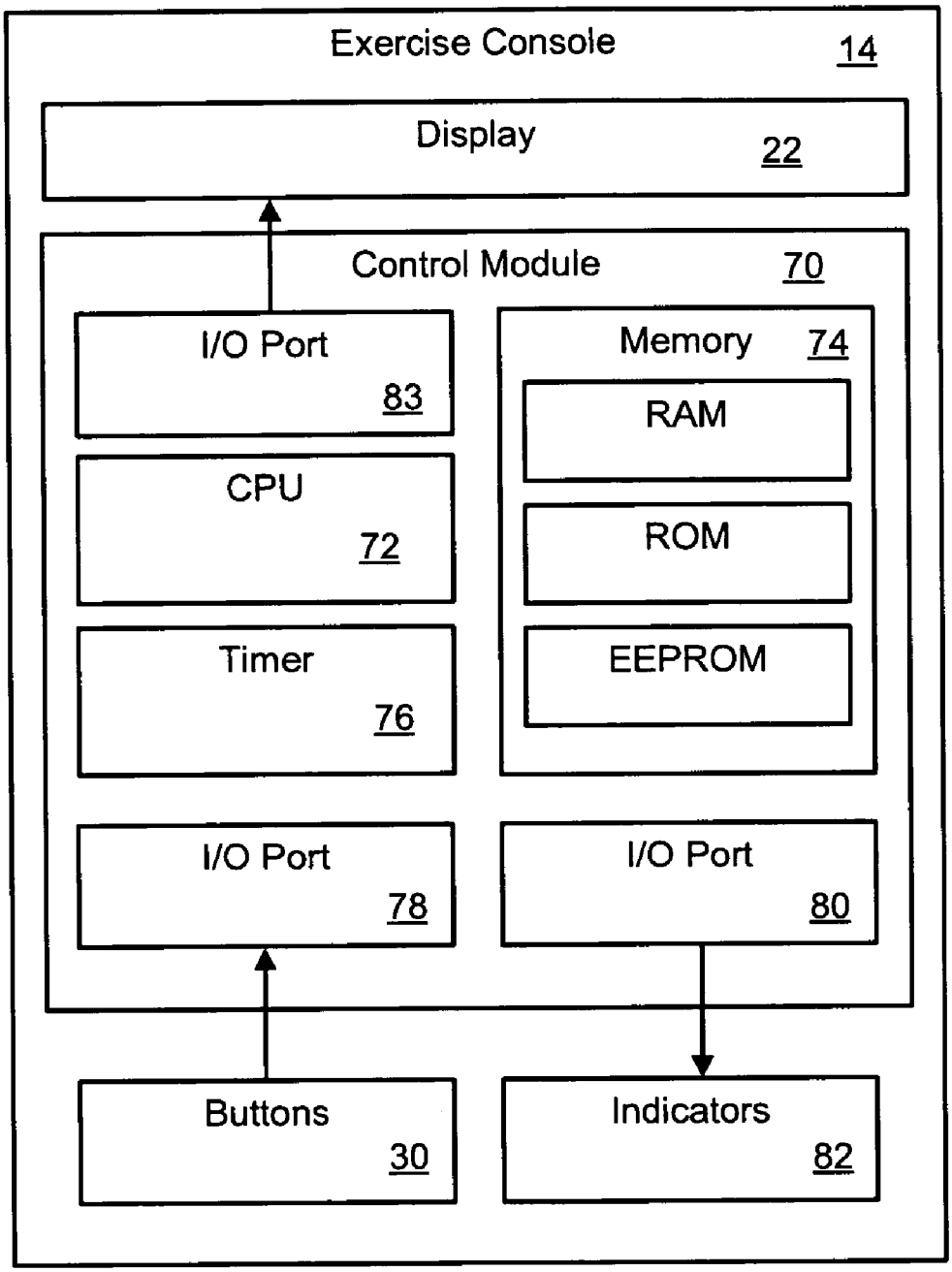
FIG. 9 is a high-level schematic block diagram showing one embodiment of electronic hardware components used to implement a method for guiding a user through programming steps of an exercise console.

Referring to FIG. 9, in one embodiment, an exercise console 14 may include a control module 70 for implementing a method like that disclosed with respect to FIG. 7A through 8D. Such a control module 70 may include, among other components, a CPU 72, memory 74, a timer 76, and the like, the likes of which are well known to those of skill in the art. Memory 74 may include, for example, ROM, EEPROM, RAM, and the like, to store executable code and operational data for implementing the above-described method. The control module 70 may also include one or more I/O ports 78 to receive input from the exercise console buttons 30 and one or more I/O ports 80 for turning on the LEDs 82 or other indicators 82 to notify the user of the buttons 30 and corresponding input options next available for selection. Similarly, one or more I/O ports 83 may be used to output data to the display 22.

Various options and alternatives for each of the components 72, 74, 76, 78, 80, 83 are available to those of skill in the art and may be provided, for example, by various off-the-shelf microcontrollers, discrete components, FPGAs, ASICs, or the like. One of ordinary skill in the art will also recognize that functionality for implementing the above-disclosed method may be provided by hardware, software, firmware, or combinations thereof.

Figure 10:
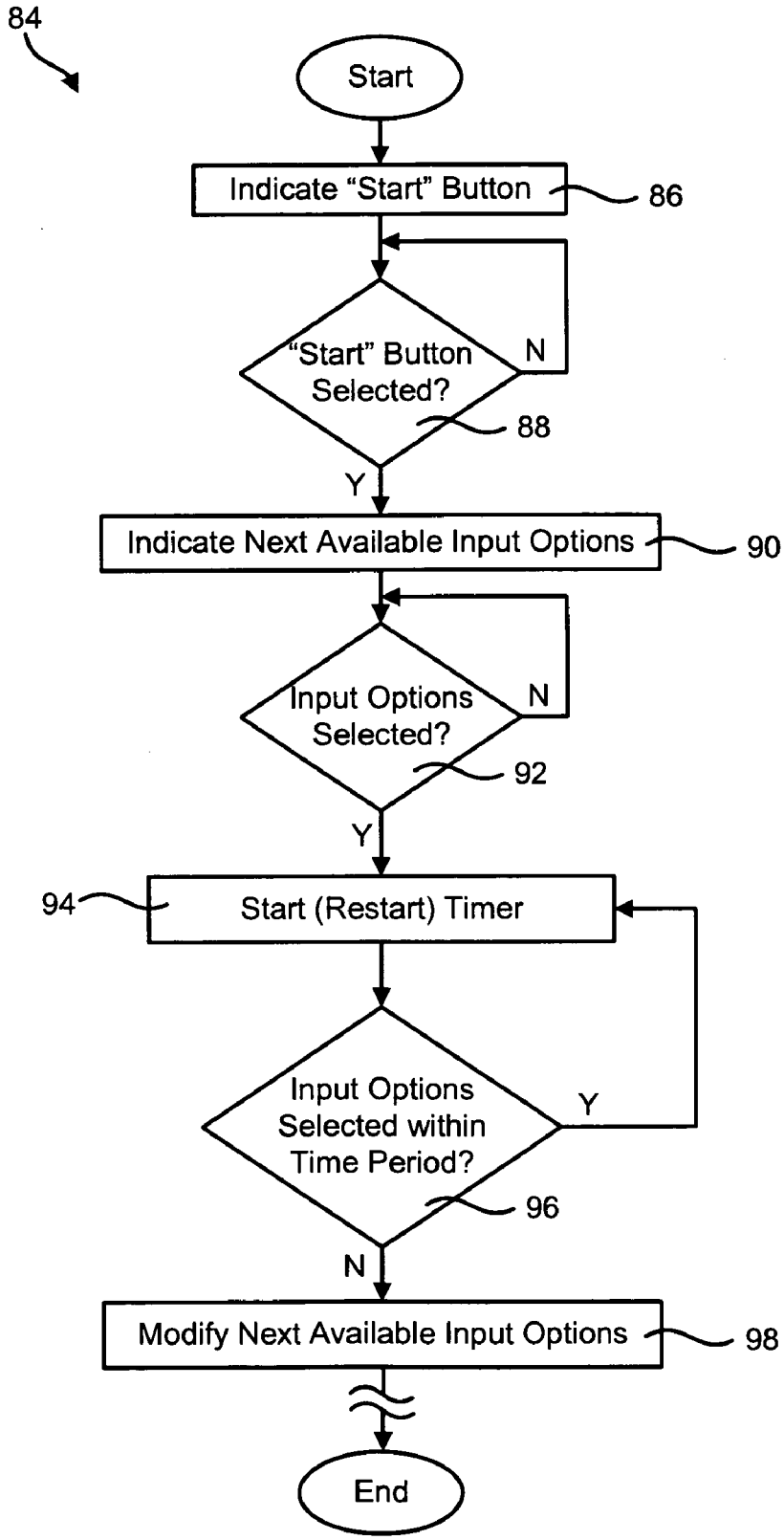
FIG. 10 is a flow chart illustrating one embodiment of a process for guiding a user through programming steps of an exercise console in accordance with the invention.

Referring to FIG. 10, one example of a method 84 for guiding a user through programming steps of an exercise console 14 may include, indicating 86 to a user a "start" or other button, the selection of which will initiate the programming process of an exercise console 14. The method 84 may then wait, at a test 88, for a user to select the "start" button. If a user selects the "start" button, the method 84 then indicates 90 (e.g., with flashing LEDs, etc.) to the user the next available buttons 30 and corresponding input options. The method 84 then waits, at a test 92, for the user to select one or more of the next available input options. If the user does select one or more of these input options, the method 84 then starts 94 (or restarts 94) a timer. If an input option is selected again within a specified period (e.g., within three seconds), at a test 96, the timer is restarted 94. However, if the an input option is not selected again within the specified period, the method 84 may then modify 98 the input options next available for selection.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A method for guiding a user through programming steps of an exercise console, the method comprising:

providing a substantially fixed away of buttons, each button thereof fixed with respect to the console, and interactive with a user;

providing to the user a plurality of input options, each selectable in a pre-determined sequence by operation of one or more of the buttons and effective to program an exercise console thereby;

selecting, by the user, at least one input option from the plurality of input options;

determining, by the console, which input options are available for selection by the user after selection of the at least one input option in accordance with which buttons then remain available for selection; and automatically indicating, to the user, which buttons and associated input options are next available for selection, by selectively activating indicators on the console, corresponding to the buttons and indicating which buttons then remain available for selection.

2. The method of claim 1, wherein the buttons are provided by an input device selected from the group consisting of a keyboard, a keypad, a console, and a housing for mounting equipment, each button being inactivated and so indicated by the corresponding indicator when not available for operation in association with the next option.

3. The method of claim 1, wherein automatically indicating comprises at least one of turning on a light, playing a sound, and changing a color to indicate which input options are available for selection.

4. The method of claim 3, wherein the light is an LED.

5. The method of claim 3, wherein the light is a flashing light.

6. The method of claim 1, wherein automatically indicating comprises backlighting the buttons next available for selection.

7. The method of claim 1, wherein the input options include at least one of selecting a workout program, selecting a workout level, setting a workout time, and setting a user weight.

8. The method of claim 1, further comprising waiting a specified period to determine whether a user has selected one of the input options next available for selection.

9. The method of claim 8, further comprising modifying the input options next available for selection, in the event that the user fails to select one of the input options after the specified period.

10. An exercise console comprising:

a housing;

a substantially fixed away of buttons, each button thereof fixed with respect to, and incorporated into the housing, the buttons providing to the user a plurality of input options, each input option selectable in a pre-determined sequence by operation of one or more of the buttons and effective to program the exercise console thereby; and a plurality of indicators associated with the buttons, each indicator corresponding to a button and selectively activated to inform the user whether or not the function of that button is available as a next option for selection after selection by the user of at least one input option.

11. The exercise console of claim 10, wherein the buttons are provided by an input device selected from the group consisting of a keyboard, a keypad, a console, and a housing for mounting equipment, each button being inactivated and so indicated by the corresponding indicator when not available for operation in association with the next option.

12. The exercise console of claim 10, wherein the indicators are selected from the group consisting of lights, sounds, and changing colors to indicate which input options are available for selection.

13. The exercise console of claim 12, wherein the lights are LEDs.

14. The exercise console of claim 12, wherein the lights are flashing lights.

15. The exercise console of claim 12, wherein the indicators are lights located away from a user-area substantially beyond the buttons.

16. The exercise console of claim 10, wherein the input options include at least one of selecting a workout program, selecting a workout level, setting a workout time, and setting a user weight.

17. The exercise console of claim 10, wherein the exercise console is configured to wait a specified period to allow a user to select one of the input options.

18. The exercise console of claim 17, wherein the exercise console is configured to modify the input options available for next selection in the event that the user fails to select one of the input options within the specified period.

19. An apparatus comprising:

an exercise machine; and an exercise console coupled to the exercise machine, the exercise console comprising:

a housing;

a substantially fixed array of buttons each button thereof fixed at a location and incorporated into the housing, the buttons providing to the user a plurality of input options, each input option selectable in a pre-determined sequence by operation of the buttons and effective to program the exercise console thereby; and a plurality of indicators associated with the buttons, each indicator corresponding to a button and selectively activated to inform the user whether the function of that button is available in association with the next available option for selection after selection by the user of at least one input option; and the fixed array and the plurality of indicators, wherein each button is inactivated and so indicated by the corresponding indicator when not available for operation in association with the next available option.

20. The exercise device of claim 19, wherein the exercise machine is selected from the group consisting of a stationary bicycle, a treadmill, an elliptical machine, a rowing machine, a climbing machine, a stair-climbing machine, a nautilus machine, and a stretching machine.

* * * * *